US005940665A

United States Patent [19]

Domoto et al.

[11] Patent Number: 5,940,665

[45] Date of Patent: Aug. 17, 1999

[54] LIQUID IMMERSION DEVELOPMENT MACHINE HAVING A MULTIPLE ZONE IMAGE DEVELOPMENT AND CONDITIONING APPARATUS

[75] Inventors: Gerald A. Domoto, Briarcliff Manor; Oscar G. Hauser, Rochester; F. James Wang, Pittsford, all of N.Y.

[73] Assignee: Xerox Corporation, Stamford, Conn.

[21] Appl. No.: 09/092,512

[22] Filed: Jun. 5, 1998

Related U.S. Application Data

[60] Provisional application No. 60/063,937, Oct. 31, 1997.

[51] Int. Cl.[6] ..... G03G 15/10

[52] U.S. Cl. ..... 399/249; 399/241

[58] Field of Search ..... 399/249, 248, 399/241, 237, 250, 57; 430/117, 118, 119

[56] References Cited

U.S. PATENT DOCUMENTS

| | | | |
|---|---|---|---|
| 5,300,990 | 4/1994 | Thompson | 399/249 X |
| 5,666,616 | 9/1997 | Yoshino et al. | 399/237 X |
| 5,758,237 | 5/1998 | Abramsohn | 399/249 |

*Primary Examiner*—Arthur T. Grimley
*Assistant Examiner*—Sophia S. Chen
*Attorney, Agent, or Firm*—Tallam I. Nguti

[57] ABSTRACT

A single image development and conditioning apparatus is disclosed for removing excess liquid carrier from a developed image developed in a liquid immersion development machine using liquid developer material having a first toner concentration. The single image development and conditioning apparatus includes a first zone located downstream of a coating device relative to a direction of movement of a surface bearing the developed image, a second zone located downstream of the first zone, and a third zone located downstream of the second zone. The first zone includes a first biased electrode for partially removing charged solid toner particles from background areas of the developed image. The second zone includes a second biased electrode for completing removal of charged solid toner particles from the background areas, and the third zone includes a third biased electrode. The first, second and third zones are arranged and biased so as to enable (i) removal, from the background areas, of liquid developer material consisting of liquid carrier and charged solid toner particles, and (ii) removal, from the image areas only, of excess carrier liquid, thereby creating a resulting toner image having a toner concentration significantly higher than the first toner concentration of the liquid developer material.

11 Claims, 4 Drawing Sheets

LIQUID IMMERSION DEVELOPMENT MACHINE HAVING A MULTIPLE ZONE IMAGE DEVELOPMENT AND CONDITIONING APPARATUS

This Application is based on a Provision Application No. 60/063,937, filed Oct. 31, 1997.

BACKGROUND OF THE INVENTION

This invention relates to liquid immersion development (LID) reproduction machines, and more particularly to such a machine having a multiple zone image development and conditioning apparatus.

Liquid electrophotographic reproduction machines are well known, and generally each includes an image bearing member or photoreceptor having an image bearing surface on which latent images are formed and developed as single color or multiple color toner images for eventual transfer to a receiver substrate or copy sheet. Each such reproduction machine thus includes a development system or systems that each utilizes a liquid developer material typically having about 2 percent by weight of charged, solid particulate toner material of a particular color, that is dispersed at a desired concentration in a clear liquid carrier.

In the electrophotographic process of a LID machine, the latent images formed on the image bearing surface of the image bearing member or photoreceptor are developed with the charged toner particles, with excess liquid carrier being left behind or removed such that the developed images typically each contain about 12 percent by weight of the toner particles. The developed image or images on the image bearing member are then further conditioned and subsequently electrostatically transferred from the image bearing surface to an intermediate transfer member. Following that, the conditioned image or images are then hot or heat transferred from the intermediate transfer member, at a heated transfer or transfix nip, to an output image receiver substrate or copy sheet.

LID machines, as above, conventionally include a liquid developer material or ink applicator for supplying or applying an even layer of the ink for image development. As pointed out, ink or liquid developer material being supplied by the applicator is about 2% solids (by weight) and developed images are on the order of 10%–15% solids (by weight). Such machines also include a biased metering roll for metering an amount of carrier fluid in the ink as well as for developing images with the metered ink. Fluid metering as such, and image development, are conventionally carried out separately, and typically by using a reverse rolling or moving metering roll. Reverse is used here in the sense that, in a nip formed between the separate metering roll and the image bearing member, the separate metering roll is moving in a direction opposite to that of the image bearing member. Reverse metering rolls have been found to produce images that are subjected to high drag out or smear effects due to high shear forces between the reverse roll and the image being developed.

LID machines typically also include a step of conditioning the initial ink developed image, so as to provide increased image stability, by raising the percent solids content of such image from the 10%–15% solids (by weight), to at least 25% (by weight). Conventionally, such image conditioning is accomplished using a device that is separate from the ink metering and image development devices. Disadvantages of conventional LID machines as such therefore include relatively larger machine architectures, relatively more machine components and hence greater costs, and relatively poorer image quality due to the shear forces.

Conventional practice in LID is then to introduce the developing liquid at point far away from the minimum gap of a development coating nip, develop the image in the nip, meter the developed image on the photoreceptor by hydrodynamic shear created by the counter rotation of a metering roll, and finally blot the image with a low solids image conditioning (LSIC) device, such as a squeegee roll. The function of the low solids image conditioning (LSIC) device is to remove excess liquid from the imaged photoreceptor and to stabilize the image. The removal of this clear liquid increases the solids concentration in the toned image areas typically from 7% to about 20%. In the process of increasing solids concentration, the liquid layer thickness is reduced from 15–20 microns down to 5 microns. Liquid thicknesses of 15–20 microns exiting the development and metering zone are obtained by rigidly maintaining a gap of about 0.002"–0.003" with very tight tolerances. To have proper development, the nip geometry is important. For example, to enable development at high process speeds with highly viscous liquids (of about 2.5 centipoise), the development zone length should be fairly long and the gap with liquid should be fairly large. This can be accomplished conventionally with a large diameter roll such as a 6" roller. However, experimental and modeling studies have shown that the metered image thickness is proportional to the metering gap but not sensitive to the metering roll diameter.

There is therefore a need for a LID reproduction machine having a liquid developer coating device and an image development and conditioning apparatus for removing, from background areas of an image being developed, liquid developer material consisting of liquid carrier and charged solid toner particles, and from image areas only excess carrier liquid, thereby creating a resulting toner image having a toner concentration significantly higher than the first toner concentration of the liquid developer material.

SUMMARY OF THE INVENTION

A single multiple zone image development and conditioning apparatus mounted along the path of movement of a member having an image bearing surface in a liquid immersion development machine for removing, from background areas of an image being developed, liquid developer material consisting of liquid carrier and charged solid toner particles, and from image areas only excess carrier liquid, thereby creating a resulting toner image having a toner concentration significantly higher than the first toner concentration of the liquid developer. The single multiple zone image development and conditioning apparatus includes a first zone located downstream of the coating device, relative to the direction of movement of the image bearing surface, the first zone including a first biased electrode for partially removing charged solid toner particles from background areas. The first electrode has a first bias and is mounted spaced a first distance from the image bearing surface. The single multiple zone image development and conditioning apparatus includes a second zone located downstream of the first zone and including a second biased electrode for completing removal of charged solid toner particles from background areas. The second electrode has a second bias and is mounted spaced a second distance, shorter than the first distance, from the image bearing. The single multiple zone image development and conditioning apparatus further includes a third zone located downstream of the second zone and including a third electrode, having a third bias and mounted spaced a third distance, shorter than the second distance. The first, second and third zones being arranges and biased as such so as to enable (i) removing, from the background areas, liquid developer material consisting of liquid carrier and charged solid toner particles, and (ii) removing, from the image areas only, excess carrier liquid, thereby creating a resulting toner image having a toner concentration significantly higher than the first toner concentration of the liquid developer.

BRIEF DESCRIPTION OF THE DRAWINGS

Other aspects of the present invention will become apparent as the following description proceeds and upon reference to the drawings, in which.

DETAILED DESCRIPTION OF THE INVENTION

Figure 1:
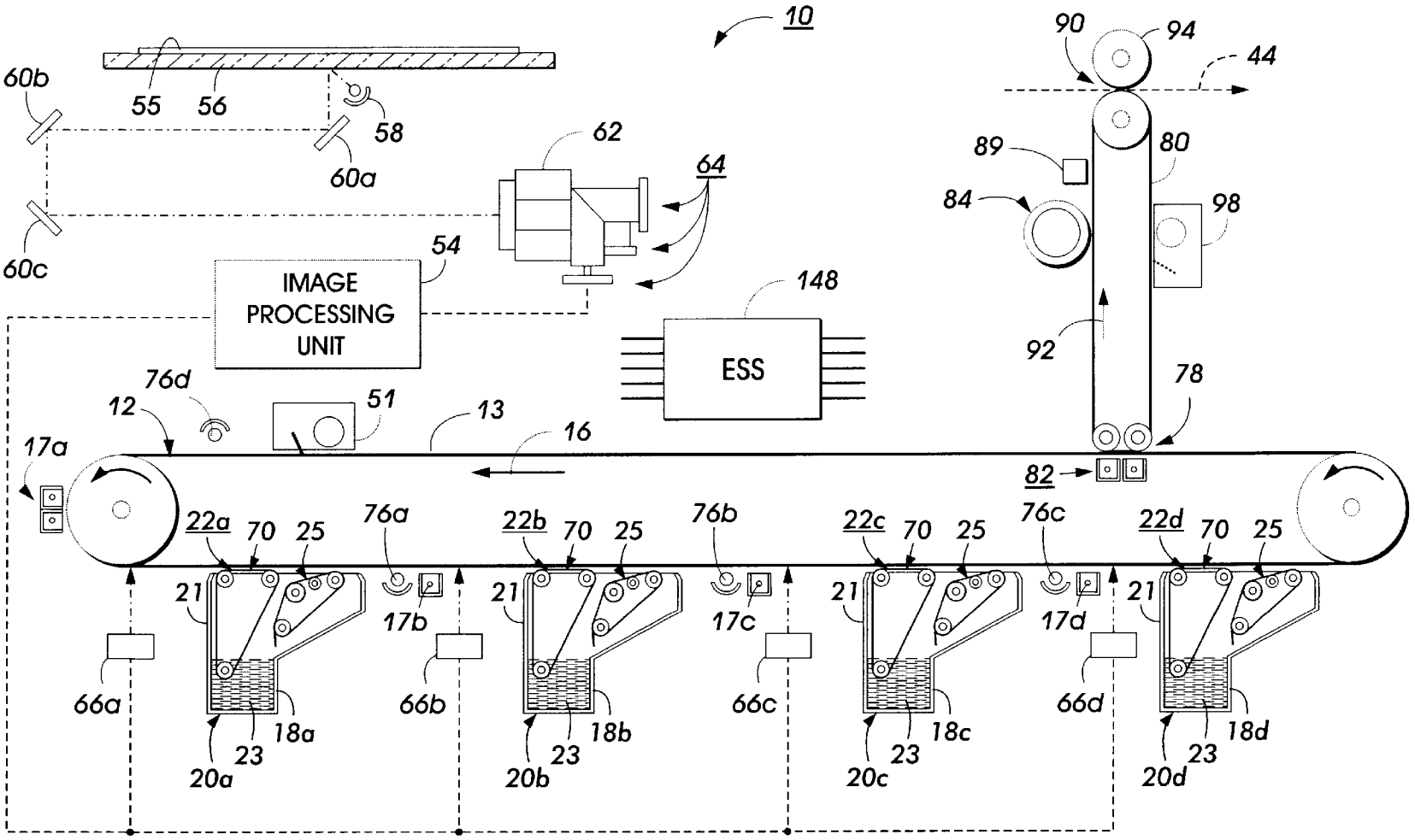
FIG. 1 is a vertical schematic of an exemplary color electrophotographic liquid immersion development (LID) reproduction machine incorporating a multiple zone image development and image conditioning apparatus in accordance with the present invention.

For a general understanding of the features of the present invention, reference numerals have been used throughout to designate identical elements. It will become evident from the following discussion that the present invention is equally well suited for use in a wide variety of reproduction machines and is not necessarily limited in its application to the particular embodiment depicted herein.

Inasmuch as the art of electrophotographic reproduction is well known, the various processing stations employed in the FIG. 1 reproduction machine will be shown hereinafter only schematically, and their operation described only briefly.

Referring now to FIG. 1, there is shown a color electrophotographic reproduction machine 10. Although a multiple color LID machine is illustrated, it is understood that the invention is equally suitable for a single color LID machine. The color copy process of the machine 10 can begin by either inputting a computer generated color image into an image processing unit 54 or by way of example, placing a color document 55 to be copied on the surface of a transparent platen 56. A scanning assembly consisting of a halogen or tungsten lamp 58 which is used as a light source, and the light from it is exposed onto the color document 55. The light reflected from the color document 55 is reflected, for example, by a 1st, 2nd, and 3rd mirrors 60*a,* 60*b* and 60*c,* respectively through a set of lenses (not shown) and through a dichroic prism 62 to three charged-coupled devices (CCDs) 64 where the information is read.

The reflected light is separated into the three primary colors by the dichroic prism 62 and the CCDs 64. Each CCD 64 outputs an analog voltage which is proportional to the intensity of the incident light. The analog signal from each CCD 64 is converted into an 8-bit digital signal for each pixel (picture element) by an analog/digital converter (not shown). Each digital signal enters an image processing unit 54. The digital signals which represent the blue, green, and red density signals are converted in the image processing unit 54 into four bitmaps: yellow (Y), cyan (C), magenta (M), and black (Bk). The bitmap represents the value of exposure for each pixel the color components as well as the color separation. Image processing unit 54 may contain a shading correction unit, an undercolor removal unit (UCR), a masking unit, a dithering unit, a gray level processing unit, and other imaging processing sub-systems known in the art. The image processing unit 54 can store bitmap information for subsequent images or can operate in a real time mode.

The machine 10 includes a photoconductive imaging member or photoconductive belt 12 which is typically multilayered and has a substrate, a conductive layer, an optional adhesive layer, an optional hole blocking layer, a charge generating layer, a charge transport layer, a photoconductive or image forming surface 13, and, in some embodiments, an anti-curl backing layer. As shown, belt 12 is movable in the direction of arrow 16. The moving belt 12 is first charged by a charging unit 17*a.* A raster output scanner (ROS) device 66*a,* controlled by image processing unit 54, then writes a first complementary color image bitmap information by selectively erasing charges on the charged belt 12. The ROS 66*a* writes the image information pixel by pixel in a line screen registration mode. It should be noted that either discharged area development (DAD) can be employed in which discharged portions are developed or charged area development (CAD) can be employed in which the charged portions are developed with toner.

Referring now to FIGS. 1–4, after the electrostatic latent image has been recorded thus, belt 12 advances the electrostatic latent image to a first multiple zone image development and conditioning apparatus 20*a* in accordance with the present invention. Like subsequent multiple zone image development and conditioning apparatus 20*b,* 20*c,* and 20*d,* the multiple zone image development and conditioning apparatus 20*a* includes a housing 21 defining a mixing chamber 23 containing liquid developer material a rotatable developer coating belt assembly 70, and a multiple zone image development and conditioning assembly 25 of the present invention. The rotatable belt assembly 70 rotating in a forward direction as shown, advances a quantity of liquid developer material 18*a,* preferably black toner developer material containing charged black toner particles at a desired concentration, into a first coating nip 22*a.* The toner particles, disseminated at the desired concentration through the liquid carrier, pass by electrophoresis to the electrostatic latent image forming a first liquid color separation developed image. As is well known, the charge of the toner particles is opposite in polarity to the charge on the photoconductive or image forming surface 13.

After the first liquid toner color separation image is conditioned in accordance with the present invention (to be described in detail below), it is advanced on belt 12 to lamp 76*a* where residual charge left on the photoconductive image bearing surface 13 is erased by flooding the photoconductive surface with light from lamp 76*a.*

As shown, according to the REaD (Recharge Expose and Develop) process of the machine 10, the liquid toner image on belt 12 is subsequently recharged with charging unit 17*b,* and is next re-exposed by ROS 66*b.* ROS 66*b* superimposing a second color image bitmap information over the previous developed latent image. Preferably, for each subsequent exposure an adaptive exposure processor is employed that modulates the exposure level of the raster output scanner (ROS) for a given pixel as a function of toner previously developed at the pixel site, thereby allowing toner layers to be made independent of each other. Also, during subsequent exposure, the image is re-exposed in a line screen registration oriented along the process or slow scan direction. This orientation reduces motion quality errors and allows the utilization of near perfect transverse registration.

At a second multiple zone image development and conditioning apparatus 20*b* in accordance with the present invention, a rotatable developer belt assembly 70 rotating in a forward direction as shown, advances a liquid developer material 18*b,* containing toner particles at a desired toner concentration, into the second coating nip 22*b.* The toner particles, disseminated through the liquid carrier, pass by electrophoresis to the previously formed liquid toner image. The charge of the toner particles is opposite in polarity to the charge on the previous developed image.

The images on belt 12 are advanced to lamp 76*b* where any residual charge left on the photoconductive surface is erased by flooding the photoconductive surface with light from lamp 76*b.* Then to similarly produce the third color separation image using the third toner color, for example magenta color toner, the toner images on moving belt 12 are recharged with charging unit 17*c,* and re-exposed by a ROS 66*c,* which superimposes a third color image bitmap information over the previous developed latent image. At the third multiple zone image development and conditioning apparatus 20*c* in accordance with the present invention, a rotatable developer coating belt assembly 70 rotating in a forward direction as shown, advances magenta liquid developer material 18*c,* containing toner particles at a desired toner concentration, into the third coating nip 22*c.* The toner particles, disseminated through the liquid carrier, pass by electrophoresis to the previously formed toner images.

The images or composite image on belt 12 are advanced to lamp 76*c* where any residual charge left on the photoconductive surface of belt 12 is erased by flooding the photoconductive surface with light from the lamp. Then finally, to similarly produce the fourth image using the fourth toner color, for example cyan color toner, the toner images on moving belt 12 are recharged with charging unit 17*d,* and re-exposed by a ROS 66*d.* ROS 66*d* superimposes a fourth color image bitmap information over the previous developed latent images. At the fourth multiple zone image development and conditioning apparatus 20*d* in accordance with the present invention, rotatable developer coating belt assembly 70 rotating in a forward direction as shown, advances a cyan liquid developer material 18*d,* containing toner particles at a desired toner concentration, into a fourth coating nip 22*d.* The toner particles, disseminated through the liquid carrier, pass by electrophoresis to the previous developed image. It should be evident to one skilled in the art that the color of toner at each image development apparatus could be in a different arrangement.

The resultant composite multicolor image, a multi layer image by virtue of different color toner development by the devices 20*a,* 20*b,* 20*c* and 20*d,* respectively having black, yellow, magenta, and cyan, toners, is then advanced to an intermediate transfer station 78. At the transfer station 78, the multicolor image is electrostatically transferred to an intermediate member 80 with the aid of a charging device 82. Intermediate member 80 may be either a rigid roll or an endless belt, as shown, having a path defined by a plurality of rollers in contact with the inner surface thereof. The multicolor image on the intermediate transfer member 80 is conditioned again for example by a blotter roller 84 which further reduces the fluid content of the transferred image by compacting the toner particles thereof while inhibiting the departure of the toner particles. Blotter roller 84 is adapted to condition the image so that it has a toner composition of more than 50 percent solids.

Subsequently, the reconditioned image on the surface of the intermediate member 80 is advanced through a liquefaction stage before being transferred within a second transfer nip 90 to an image recording sheet 44. Within the liquefaction stage, particles of toner forming the transferred image are transformed by a heat source 89 into a tackified or molten state. The heat source 89 can also be applied to member 80 internally. The intermediate member 80 then continues to advance in the direction of arrow 92 until the tackified toner particles reach the transfer nip 90.

The transfer nip 90 is more specifically a transfixig nip, where the multicolor image is not only transferred to the recording sheet 44, but it is also fused or fixed by the application of appropriate heat and pressure. At transfix nip 90, the liquefied toner particles are forced, by a normal force applied through a backup pressure roll 94, into contact with the surface of recording sheet 44. Moreover, recording sheet 44 may have a previously transferred toner image present on a surface thereof as the result of a prior imaging operation, Le. duplexing. The normal force, produces a nip pressure which is preferably about 20 psi and may also be applied to the recording sheet via a resilient blade or similar spring-like member uniformly biased against the outer surface of the intermediate member across its width.

As the recording sheet 44 passes through the transfix nip 90 the tackified toner particles wet the surface of the recording sheet, and due to greater attractive forces between the paper and the tackified particles, as compared to the attraction between the tackified particles and a liquid-phobic surface of member 80, the tackified particles are completely transferred to the recording sheet. As shown, the surface of the intermediate transfer belt 80 is thereafter cleaned by a cleaning device 98 prior to receiving another toner image from the belt 12.

Invariably, after the multicolor image was transferred from the belt 12 to intermediate member 80, residual liquid developer material remained adhering to the photoconductive surface of belt 12. A cleaning device 51 including a roller formed of any appropriate synthetic resin, is therefore provided as shown and driven in a direction opposite to the direction of movement of belt 12 to scrub the photoconductive surface clean. It is understood, however, that a number of photoconductor cleaning means exist in the art, any of which would be suitable for use with the present invention. Any residual charge left on the photoconductive surface after such cleaning is erased by flooding the photoconductive surface with light from a lamp 76*d* prior to again charging the belt 12 for producing another multicolor image as above.

As illustrated the reproduction machine 10 further includes an electronic control subsystem (ESS) shown as 148 for controlling various components and operating subsystems of the reproduction machine. ESS 148 thus may be a self-contained, dedicated minicomputer, and may include at least one, and may be several programmable microprocessors for handling all the control data including control signals from control sensors for the various controllable aspects of the machine.

Figure 2:
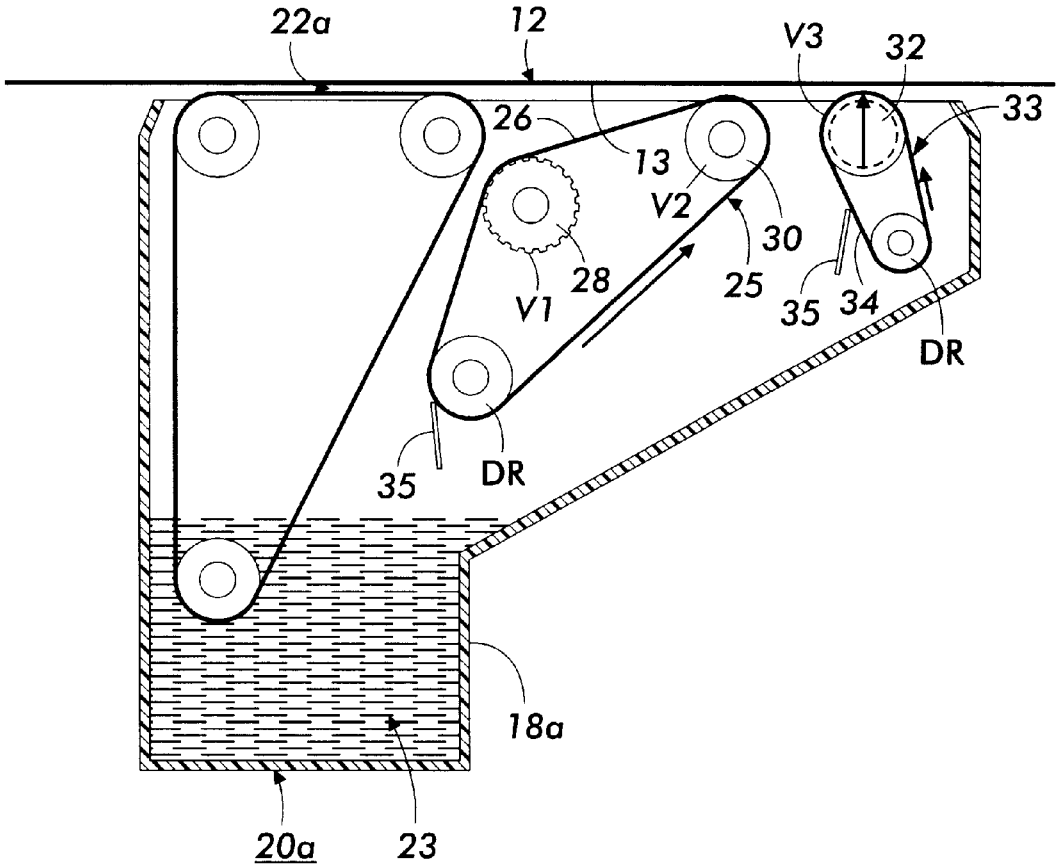
FIG. 2 is a vertical schematic of a first embodiment of the multiple zone image development and conditioning apparatus of the present invention.
Figure 3:
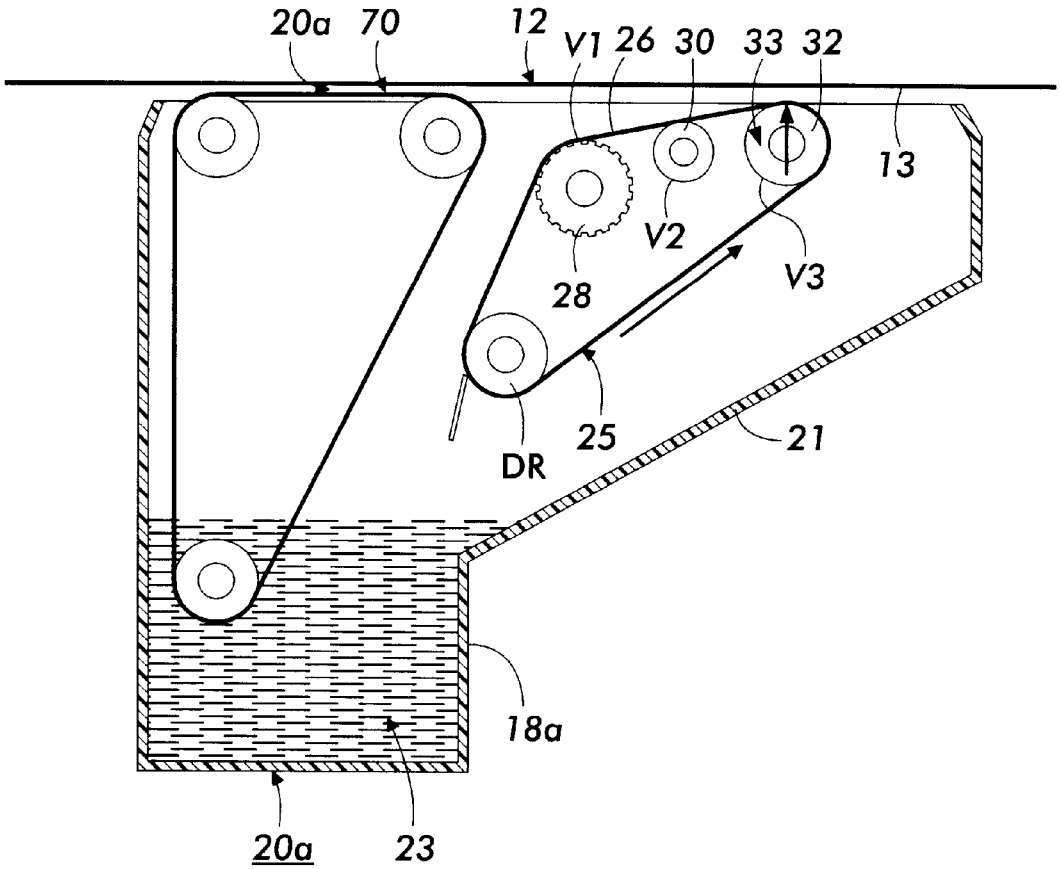
FIG. 3 is a vertical schematic of a second embodiment of the multiple zone image development conditioning apparatus of the present invention.
Figure 4:
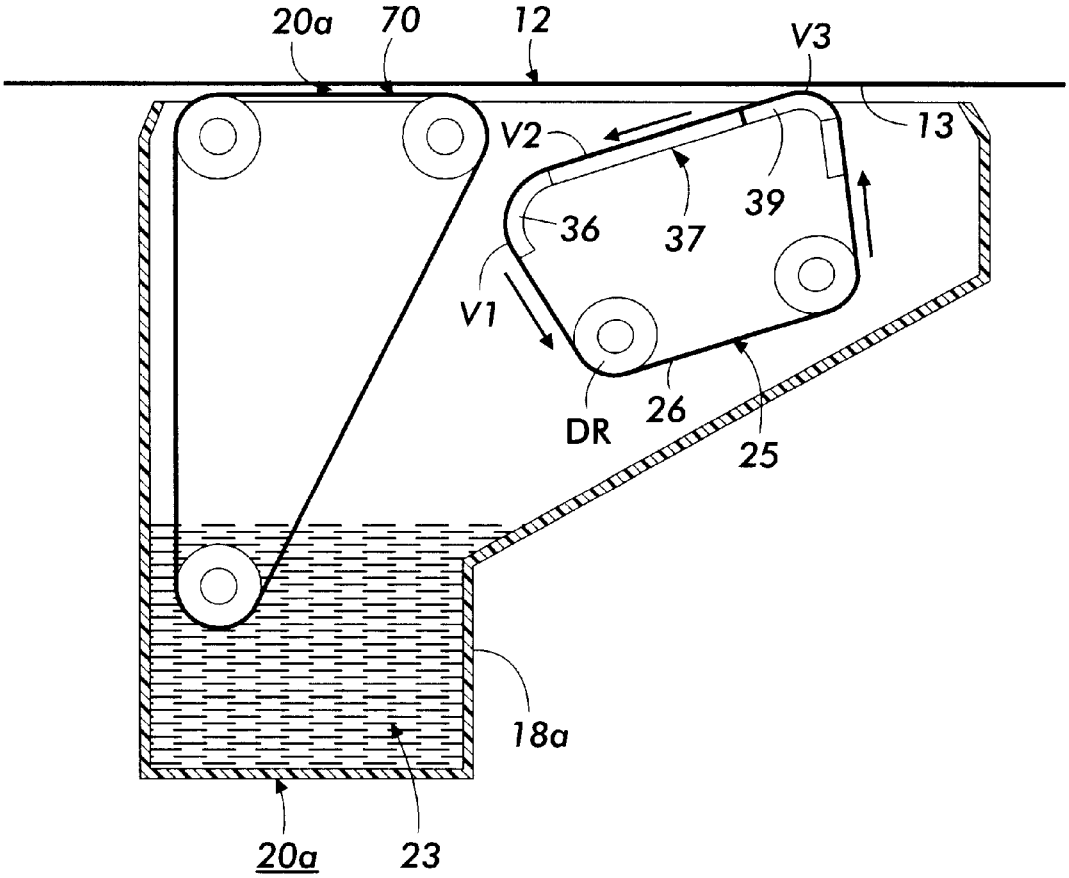
FIG. 4 is a vertical schematic of a third embodiment of the multiple zone image development and conditioning apparatus of the present invention.

Referring now to FIGS. 2–4, in accordance with the present invention, several embodiments of a multiple zone, single LID image development and conditioning apparatus or device 20*a,* 20*b,* 20*c,* 20*d* are provided for developing the latent image to create a developed image, and conditioning the developed image by raising its solids content from the 10%–15% solids (by weight), to at least 25% (by weight). The multiple zone LID image development and conditioning device 20*a,* 20*b,* 20*c,* 20*d* includes the rotatable developer coating belt assembly 70 for moving developer material, through the a coating nip 22*a,* 22*b,* 22*c,* and 22*d,* in the same or forward direction as the moving image bearing member 12. The multiple zone LID image development and conditioning device 20*a,* 20*b,* 20*c,* 20*d* also includes the multiple zone development and conditioning device 25 which has a funnel-shaped development and conditioning region for causing each exiting developed toner image to have a solids concentration of about 20%, and a fluid layer thickness of about 5 microns, thus making further removal of fluid unnecessary. As shown, each device 25 includes a metering and conditioning belt 26 for drastically removing excess carrier liquid from the toned layer on the surface 13. It does so by utilizing a very narrow metering gap that is controlled by pressurized air or other fluid.

In FIGS. 2 and 3, first and second embodiments of the multiple zone image development and conditioning apparatus are illustrated. As shown, each embodiment includes a coating assembly comprising the coating belt assembly 70 for example. It also includes a multiple zone development and conditioning device 25 that has a development and metering or conditioning belt 26 that is mounted over rigidly spaced rolls including a drive roll DR and electrode rolls 28, 30, and 32 forming first second and third development and conditioning zones. The total length of the development conditioning zones is determined by a center to center spacing between the rolls, and the diameters of the electrode rolls 28, 30, and 32 can be optimized to be consistent with a desired belt life and desired overall compactness for the device 25. As shown, the first two electrode rolls, 28, 30 each moves with the belt 26. The third electrode roll 32 forms part of an air bearing device 33, and is stationary. In the first embodiment FIG. 2, the air bearing device 33 is separate from the development device 25, but in the second embodiment shown in FIG. 3, the air bearing device 33 is part of the device 25. The construction of the air bearing device 33 is such as to prevent the accumulation of carrier liquid or fluid on the inside of its belt, 26 (FIG. 3), 34 (FIG. 2). On each device (25, 33) pressure of a skiver 35 against the belt 26, 34 and against the drive roll DR acts to keep positive frictional contact between the belt 26, 34 and the drive roll DRA.

As shown, for the first and second embodiments, voltages V1, V2 and V3 (first, second and third biases respectively) are applied to the electrode rollers 28, 30, and 32 so that development and metering or conditioning fields are set up and are effective in zones 1, 2 and 3, that is, in the first, second, and third zones of the device 25 and 33. The conditioning belt 26 preferably is semi-conductive belt, and has a resistivity of about $10^8$ ohm-cm so as to be able to support voltage differences of about 1000 volts for a 30 cm width of belt, while drawing only about 30 amps per cm of length between zones. It (the belt 26) should also be chosen so that current to it from development does not affect the potential distribution along its length. As such, power supply drain is minimal for reasonable values of V1, V2, and V3.

Importantly, in accordance with the present invention, V1 and V2 on the one hand are standard development biases designed to prevent development of background areas of an image being developed, (toner from such background areas thus instead accumulates on the belt 26 and is taken away from the development and conditioning zones continuously). On the other hand, V3 has a polarity that is the same as the polarity of the toner particles so as repel such particles away from the belt 26, 34, and onto the surface 13, thus leaving a mostly clear, low viscosity liquid carrier layer next to the belt 26, 34. As such, shearing between the toner and liquid layer occurs in the lower viscosity clear liquid layer during separation between the surfaces as they exit from the third zone.

In accordance with the present invention, the function of the air bearing device 33 in the third zone is to force the development and metering belt 26 into close proximity with the surface 13 of the image bearing member 12, and to control the fluid (plus toner particle) layer thickness, i.e. the gap in the exit or third zone. Control of the gap is therefore achieved by air pressure rather than by rigid gap spacing adjustment. By spacing the stationary roll 32 of the air bearing device 33 (FIG. 2) close to the photoreceptor or image bearing member 12, (so that the belt 34 is about 002" from the surface 13, when there is no air flow in the air bearing) an exit zone image film thickness of about 5 microns can be achieved given, the right design of air channels, and a selection of pressure to match fluid viscosity, of belt material, of hickness and of tension. As such, the metering and conditioning belt 34 of the air device 33 has to move vertically only slightly, and so the required deformation would be within the elastic limit of the belt material.

The effect of V1 and V2, combined with the imaging voltages, is to produce electric fields which cause sufficient toner particle accumulation in the image areas on the photoreceptor 12, as well as removal of toner particles from background areas. In the first zone (zone 1), development starts and continues until the V1 field is partially attenuated. In the second zone (zone 2) image development continues because of the closer spacing of the roll 30, and the stronger V2 field. The field inside the toner layer serves to increase its microscopic solids concentration meanwhile continuing to clear background toner particles from the fluid and carry them away; in the third zone (zone 3), with a reversed polarity bias V3. In the third zone, the resistivity of the belt 34 acts as a voltage divider and the V3 field reverses as the image moves from zone 2 to zone 3, thus forcing the toner particles onto the surface 13 leaving a mostly clear liquid layer next to the belt 34. As the image enters zone 3, the effective background restraining biases V1, V2 in zones 1 and 2 have enabled a background free development. Upon exiting from zone 3, there will be a split in the clear liquid layer due to a step change in viscosity, leaving the toner image undamaged with a very high solids concentration (5 microns corresponding to about 20% at 0.1 mg/cm$^2$ deposition).

As shown in FIG. 4, a third embodiment of the single, multiple zone apparatus includes use of a stationary, biased shaped shoe electrode 37 as a backing for the development belt 26. In each of these embodiments, the development and conditioning belts 26, 34 can be either conductive or semi-conductive. The shape of the shoe electrode 37 can be tailored to optimize development, and the belt 26 can move either with or against the motion of the photoreceptor 12. An air knife can also be used as a special case of an air bearing in each of these embodiments. It is understood too that although air is describes as the pressurized fluid in the bearing, other fluids can be substituted for air.

In the third embodiment of FIG. 4, with the stationary shaped electrode 37, the metering function in zone 3 is separated from the developing functions of zones 1 (a first portion 36) and 2 (middle portion 36) so that electrical bias V3 in zone 3 (a third portion 39) can be more independent of the biases V1, V2 applied in development zones 1 and 2.

The stationary shoe electrode 37 preferably is made of either a porous or a solid conductor with an internal air chamber. The stationary electrode 37 is separated by either a porous or a solid dielectric so that background suppression biases V1, V2 can be applied to the development zones 1 and 2 and a separate bias V3 can be applied to the exit part of the metering third zone 39. Third third zone portion 39 of the shoe electrode 37 at the exit of the metering or third zone is preferably made of a porous conductor. The conductive development and metering belt 26 thereof is driven over the shoe electrode 37 by drive roll DR as shown.

As can be seen, there has been provided, an electrostatographic liquid immersion development (LID) reproduction machine having an image bearing member including an image bearing surface having a direction of movement and defining a path of movement; latent image forming devices mounted along the path of movement for forming a latent image having image areas and background areas on the image bearing surface; a coating device, mounted along the path of movement and supplying viscous liquid developer material consisting of liquid carrier and charged solid toner particles at a first concentration, for developing both image areas and background areas of the latent image; and a single multiple zone image development and conditioning apparatus mounted along the path of movement for removing from the background areas liquid developer material consisting of liquid carrier and charged solid toner particles, and from the image areas only excess carrier liquid, thereby creating a resulting toner image having a toner concentration significantly higher than the first toner concentration of the liquid developer.

The single multiple zone image development and conditioning apparatus includes a first zone located downstream of the coating device, relative to the direction of movement of the image bearing surface, the first zone including a first biased electrode for partially removing charged solid toner particles from background areas. The first electrode has a first bias and is mounted spaced a first distance from the image bearing surface. The single multiple zone image development and conditioning apparatus includes a second zone located downstream of the first zone and including a second biased electrode for completing removal of charged solid toner particles from background areas. The second electrode has a second bias and is mounted spaced a second distance, shorter than the first distance, from the image bearing. The single multiple zone image development and conditioning apparatus further includes a third zone located downstream of the second zone and including a third electrode, having a third bias and mounted spaced a third distance, shorter than the second distance. The first, second and third zones being arranges and biased as such so as to enable (i) removing, from the background areas, liquid developer material consisting of liquid carrier and charged solid toner particles, and (ii) removing, from the image areas only, excess carrier liquid, thereby creating a resulting toner image having a toner concentration significantly higher than the first toner concentration of the liquid developer.

The single multiple zone image development and conditioning apparatus also includes a continuous belt mounted movably over the first, the second, and the third electrodes for compacting charged solid toner particles in image areas against the image bearing surface, and removing excess liquid carrier from the image bearing surface. The belt forms a long funnel-shaped toner image forming nip with the image bearing surface for preventing excess liquid carrier for moving downstream past the third electrode, thereby creating a resulting toner image having a toner concentration suitable for subsequent processing without a further need for separate excess liquid carrier removal.

While the embodiment disclosed herein is preferred, it will be appreciated from this teaching that various alternative, modifications, variations or improvements therein may be made by those skilled in the art, which are intended to be encompassed by the following claims:

What is claimed is:

1. A liquid immersion development reproduction machine comprising:

(a) a movable image bearing member having an image bearing surface, said image bearing surface having a direction of movement and defining a path of movement;

(b) latent image forming means mounted along said path of movement for forming a latent image having image areas and background areas on said image bearing surface;

(c) a liquid developer material coating device, mounted along said path of movement and supplying viscous liquid developer material consisting of liquid carrier and charged solid toner particles at a first concentration, forming both image areas and background areas of the latent image; and (d) a single apparatus toner image forming and metering apparatus mounted along said path of movement for removing from the background areas liquid developer material consisting of liquid carrier and charged solid toner particles, and from the image areas only excess liquid carrier, thereby creating a resulting toner image having a toner concentration significantly higher than the first toner concentration of the liquid developer, said single apparatus toner image forming and metering apparatus having:

(i) a first zone located downstream of said coating device, relative to said direction of movement of said image bearing surface, said first zone including a first biased electrode for partially removing charged solid toner particles from background areas, said first electrode having a first bias, and being mounted spaced a first distance from said image bearing surface;

(ii) a second zone located downstream of said first zone and including a second biased electrode for completing removal of charged solid toner particles from background areas, said second electrode having a second bias, and being mounted spaced a second distance, shorter than said first distance, from said image bearing surface; and (iii) a third zone located downstream of said second zone having a third bias and including a third electrode spaced a third distance, shorter than said second distance for developing and conditioning liquid developer images having a toner concentration suitable for subsequent processing without a further need for separate excess liquid carrier removal.

2. The liquid immersion development reproduction machine of claim 1, including a continuous belt mounted movably over said first, said second, and said third electrodes of said first, second and third zones respectively for compacting charged solid toner particles in image areas against said image bearing surface, and for removing excess liquid carrier from said image bearing surface for preventing excess liquid carrier from moving downstream past said third electrode, thereby creating a resulting toner image having a toner concentration suitable for subsequent processing without a further need for separate excess liquid carrier removal.

3. The liquid immersion development reproduction machine of claim 2, wherein said continuous belt forms a long funnel-shaped toner image forming nip with said image bearing surface for preventing excess liquid carrier from moving downstream past said third electrode.

4. The liquid immersion development reproduction machine of claim 2, wherein said single apparatus toner image forming and metering apparatus includes a drive member mounted upstream of said first electrode and into driving engagement with said continuous belt for driving said continuous belt over said first, said second and said third electrodes.

5. The liquid immersion development reproduction machine of claim 4, wherein said drive member is mounted for drivingly moving said continuous belt in a direction that is opposite to said direction of said image surface through said first and second zones.

6. The liquid immersion development reproduction machine of claim 2, wherein said first and said second electrodes are each a rotatable member mounted for movement with said continuous belt.

7. The liquid immersion development reproduction machine of claim 6, wherein said third electrode comprises a stationary member formiing an exit point, said exit point being a narrowest gap point between said image bearing surface and said continuous belt within said first and second zones.

8. The liquid immersion development reproduction machine of claim 6, wherein said third electrode is fluid porous, and comprises a fluid bearing including a source of pressurized fluid for gently forcing said continuous belt towards said image bearing surface, thereby controlling a size of a metering gap and further preventing any liquid carrier from moving downstream past said third electrode, and thereby also compacting toner particles in image areas on said image bearing surface.

9. The liquid immersion development reproduction machine of claim 6, wherein said second bias of said second electrode is greater in magnitude than said first bias of said first electrode for effecting removal of charged toner particles from background areas on said image bearing surface.

10. The liquid immersion development reproduction machine of claim 2, wherein said first and said second electrodes comprise stationary shoe members over which said continuous belt is mounted for movement.

11. A single multiple zone image development and conditioning apparatus mounted, in a liquid immersion development machine along a path of movement of an image bearing member having an image bearing surface, for removing from background areas of an image being developed liquid developer material consisting of liquid carrier and charged solid toner particles, and from image areas only excess liquid carrier, thereby creating a resulting toner image having a toner concentration significantly higher than a first toner concentration of the liquid developer, the single multiple zone image development and conditioning apparatus comprising:

(a) a first zone, relative to a direction of movement of the image bearing surface, located downstream of a coating device applying liquid developer material to the image bearing surface, said first zone including a first biased electrode for partially removing charged solid toner particles from background areas of an image coated with liquid developer material, said first electrode having a first bias and being mounted spaced a first distance from the image bearing surface;

(b) a second zone located downstream of the first zone and including a second biased electrode for completing removal of charged solid toner particles from background areas, the second electrode has a second bias and is mounted spaced a second distance, shorter than the first distance, from the image bearing surface; and (c) a third zone located downstream of the second zone and including a third electrode, having a third bias and mounted spaced a third distance, shorter than the second distance, said first, second and third zones being arranged and biased as such so as to enable (i) removing, from the background areas, liquid developer material consisting of liquid carrier and charged solid toner particles, and (ii) removing, from the image areas only, excess liquid carrier, thereby creating a resulting toner image having a toner concentration significantly higher than a first toner concentration of the liquid developer.

* * * * *